US012325948B2

(12) United States Patent
Ehrlich et al.

(10) Patent No.: US 12,325,948 B2
(45) Date of Patent: Jun. 10, 2025

(54) WASHING MACHINE AND/OR DRYER

(71) Applicant: Miele & Cie. KG, Gütersloh (DE)

(72) Inventors: Bea Ehrlich, Bielefeld (DE); Alfons Eblenkamp, Rietberg (DE); Carolin Kaudewitz, Gütersloh (DE)

(73) Assignee: MIELE & CIE. KG, Gütersloh (DE)

( * ) Notice: Subject to any disclaimer, the term of this patent is extended or adjusted under 35 U.S.C. 154(b) by 667 days.

(21) Appl. No.: 17/636,596

(22) PCT Filed: Aug. 13, 2020

(86) PCT No.: PCT/EP2020/072734
§ 371 (c)(1),
(2) Date: Feb. 18, 2022

(87) PCT Pub. No.: WO2021/032586
PCT Pub. Date: Feb. 25, 2021

(65) Prior Publication Data

US 2022/0298714 A1 Sep. 22, 2022

(30) Foreign Application Priority Data

Aug. 20, 2019 (DE) ..... 102019122324.5

(51) Int. Cl.

| | |
|---|---|
| ***D06F 39/14*** | (2006.01) |
| ***D06F 25/00*** | (2006.01) |
| ***D06F 34/10*** | (2020.01) |
| ***D06F 58/20*** | (2006.01) |

(52) U.S. Cl.
CPC ..... *D06F 39/14* (2013.01); *D06F 25/00* (2013.01); *D06F 34/10* (2020.02); *D06F 58/20* (2013.01)

(58) Field of Classification Search
CPC ..... D06F 39/14; D06F 25/00; D06F 34/10; D06F 58/20; D06F 39/12; D06F 37/26; D06F 37/42
See application file for complete search history.

(56) References Cited

FOREIGN PATENT DOCUMENTS

| | | | | |
|---|---|---|---|---|
| CA | 2266293 A1 * | 9/1999 | ..... | B65D 17/4011 |
| CN | 207340115 U * | 5/2018 | | |
| EP | 2708633 A1 | 3/2014 | | |
| EP | 2843102 A1 | 3/2015 | | |
| EP | 3190221 A1 | 7/2017 | | |
| FR | 2858811 A1 * | 2/2005 | ..... | B65D 9/32 |
| JP | 2007035598 A * | 2/2007 | | |

OTHER PUBLICATIONS

Translation, FR-2858811-A1 (Year: 2005).*
Translation, JP-2007035598-A (Year: 2007).*
Translation, CN-207340115-U (Year: 2).*
International Search Report dated Nov. 4, 2020.

* cited by examiner

*Primary Examiner* — Jessica Yuen
(74) *Attorney, Agent, or Firm* — Dickinson Wright PLLC

(57) ABSTRACT

A washing machine and/or dryer, having a housing, a flap integrated into the housing, and a tab made of a soft and/or flexible material, which tab is arranged on the flap such that it is arranged in a protruding manner relative to the housing and the flap, and is designed such that, by pulling on the tab, a folding of the flap from the housing is triggered.

7 Claims, 2 Drawing Sheets

WASHING MACHINE AND/OR DRYER

RELATED APPLICATIONS

The present disclosure claims priority to and is a 35 U.S.C. § 371 national phase application of PCT/EP2020/072734, filed Aug. 13, 2020 which claims priority to and the benefit of German Application 10 2019 122 324.5 filed on Aug. 20, 2019, the entire contents of which are incorporated herein by reference.

TECHNICAL FIELD

The disclosure relates to a washing machine and/or dryer. In particular, the disclosure relates to a washing machine and/or dryer having a housing and a flap integrated into the housing. A combination of washing machine and dryer is also known as a washer-dryer.

BACKGROUND

It is known from prior art that is not documented that such a flap on a washing machine, washer-dryer, or dryer can be opened by means of a pivoting plug covering a recess or by means of a button that allows an unlocking and opening of the flap. Alternative elements designed to open the flap are fixed, such as a grip strip or a protruding handle, which are made of a hard material. These flap opening elements are either very conspicuous or very complex to design, since the region behind the flap often has to be covered for safety reasons. In the case of protruding elements, there is also a risk of injury for a user of the washing machine and/or dryer. If the flap opening elements are made very small, there may be difficulties in gripping them securely.

SUMMARY

The present disclosure addresses the problem of providing a washing machine and/or dryer with a housing and a flap integrated in the housing, which has an element for opening the flap, which element eliminates the risk of injury to the user and is easy to integrate.

According to the disclosure, this problem is solved by a washing machine and/or dryer having the features of claim 1. Advantageous embodiments and developments of the disclosure can be found in the following dependent claims.

The advantages that can be achieved with the disclosure are, in addition to the provision of an opening element for opening the flap in the form of a tab, which prevents the user from being injured, that the tab is self-explanatory and no other aid is required to open the flap. The tab allows a secure grip to open the flap. In addition, no opening in the housing and/or in the flap and its seal is required for the tab. Additional access protection is superfluous. Furthermore, no expensive tools are required to produce the tab, as is the case, for example, with injection molding. The tab can also be produced in numerous variants and can easily be adapted to washing machine and/or dryer variants.

The disclosure relates to a washing machine and/or dryer, having a housing, a flap integrated into the housing, and a tab made of a soft and/or flexible material, which tab is arranged on the flap such that it is arranged in a protruding manner relative to the housing and the flap, and is designed such that, by pulling on the tab, a folding of the flap from the housing is triggered.

Within the meaning of the disclosure, a soft material is a material that is not hard or strong. Rather, the material is designed to yield slightly under pressure. The soft material is in particular such that the shape can be changed easily, i.e. with little effort.

For the meaning of the disclosure, the expression "flexible material" means a pliable or resilient material.

The flap is integrated into the housing such that, when closed, it closes an opening, for example in the form of a chamber and/or a compartment, which is arranged in the housing. For example, the chamber and/or the compartment serves as a storage or stock space for agents that are to be used in the washing machine and/or dryer, such as detergents, cleaning agents, or the like. The chamber and/or the compartment can alternatively also be part of an automatic dosing system, in which predetermined containers are to be arranged for the automatic dosing system. In a preferred embodiment, the washing machine or washer-dryer has the automatic dosing system, which is accessible to the user by opening the flap to the extent that the user can arrange one or more detergent-containing containers in the opening.

The tab is arranged in a protruding manner relative to the housing and the flap. This makes the tab easily accessible for the user. Information on position and direction relates to an operational set-up position of the washing machine and/or dryer.

In a preferred embodiment, the tab is attached to a tab attachment region of the flap opposite a hinge region of the flap. This will continue to help the flap release when the user pulls on the tab. The hinge region is a region, along the extension direction thereof a hinge for folding the flap is arranged.

The tab is preferably arranged on an upper region of the flap, relative to an operational set-up position of the washing machine and/or dryer. This can prevent the user from having to bend down too far in order to be able to pull on the tab. The tab attachment region is the top region of the flap while the hinge region is the bottom region of the flap.

In a preferred embodiment, the tab is designed in the form of a loop. As a result, the tab can be easily gripped and/or pulled by the user. This is particularly advantageous for users with limited mobility, such as rheumatism patients, because they can insert a finger into a tab opening shaped in the form of a loop and can thus easily pull on the tab.

The tab is preferably screwed to the flap and/or clamped in therein. This keeps the tab securely and firmly attached to the flap.

In a preferred embodiment, the tab has at least one light guide. Text(s) and/or symbol(s) can be imaged on the tab by means of the light guide(s), which, for example, indicate the content behind the flap. By means of the light guide(s), information such as "Changing the containers of the automatic dosing system necessary" can be communicated. In addition, the light guide can point to the tab as an opening aid, for example in a darkened room such as a basement.

The tab preferably has a fabric into which the at least one light guide is woven, braided, and/or injected. As a result, the light guide is well connected to the fabric and cannot become detached from it over time.

In a preferred embodiment, one end of the at least one light guide is routed into the hinge region of the flap and is arranged and designed in such a way that it can be supplied with electricity from a power supply arranged inside the washing machine and/or dryer. The light guide does not require its own power supply device, which means that components and costs can be saved. Since it is a relatively low energy input, there is no risk of electrocution.

The tab is preferably made of fabric and/or plastics material, in particular the fabric. These materials preclude injury to the user when pulling on the tab. More preferably, the tab is made of plastics material. As a result, wear and tear on the tab is minimal.

The washing machine and/or dryer preferably has feet on which it stands in the operational set-up position, and the flap is integrated into a lower region of the housing. The feet allow an easy folding of the flap without damaging a surface on which the washing machine and/or dryer is installed.

BRIEF DESCRIPTION OF THE DRAWINGS

An embodiment of the present disclosure is shown in the drawings in a purely schematic manner and will be described in more detail below. In the drawings.

DETAILED DESCRIPTION OF THE DRAWINGS

Figure 1:
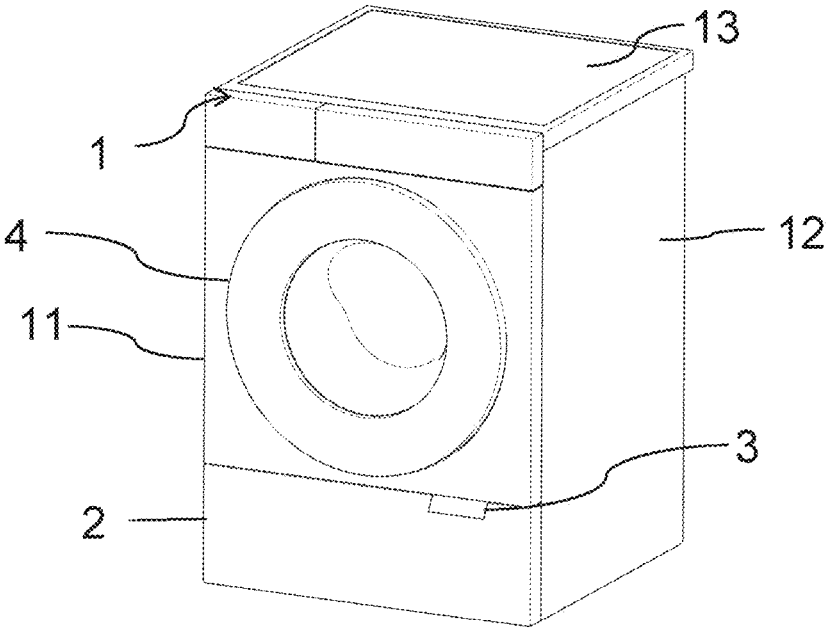
FIG. 1 is a perspective view of a washing machine according to the disclosure with a flap in the closed state.

FIG. 1 is a perspective view of a washing machine according to the disclosure with a flap in the closed state. The washing machine has a housing 1 which has a front wall 11, side walls 12, and a top wall 13 in the operational set-up position. A door 4 is arranged in the front wall 11 in order to allow the user to fill the washing machine with laundry. A flap 2 is also integrated into the housing 1 and is closed in FIG. 1. The washing machine also has a tab 3 made of a soft and/or flexible material, which is designed such that, by pulling on the tab 3, a folding of the flap 2 from the housing 1 is triggered.

Figure 2:
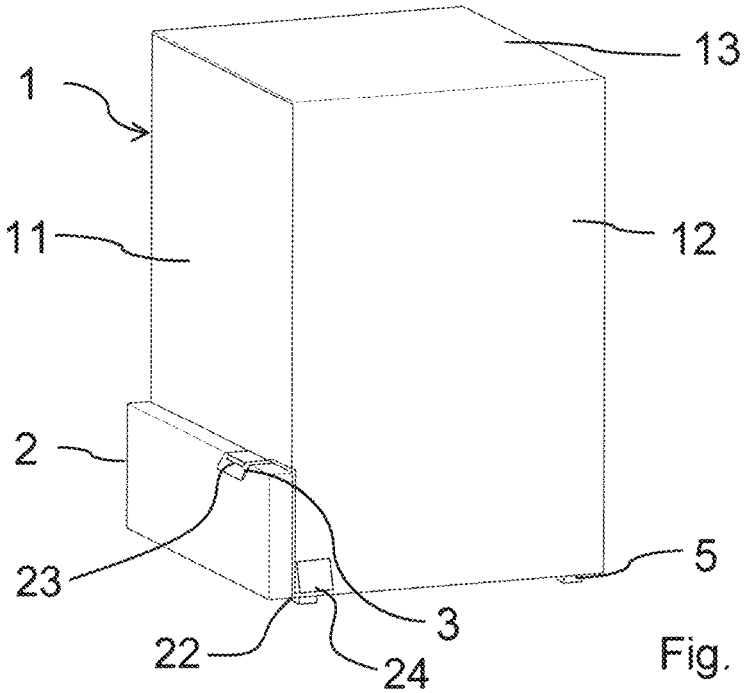
FIG. 2 is another perspective view of the washing machine shown in FIG. 1 with the flap partially open.
Figure 3:
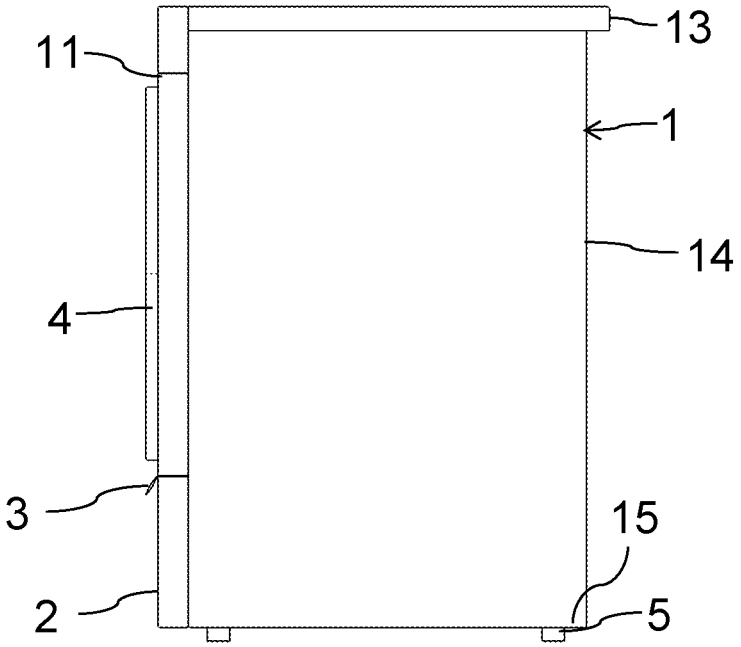
FIG. 3 is a side view of the washing machine shown in FIG. 1.

FIG. 2 shows a further perspective view of the washing machine shown in FIG. 1 with the flap partially open, the door not being shown for the sake of clarity. The flap 2 is not closed but is partially folded, in particular pulled out. The tab 3 is attached to an upper region, in particular a tab attachment region (not shown) of the flap 2 which is opposite a lower region, in particular a hinge region 22, of the flap 2. The tab 3 is screwed to the flap 2 and/or clamped in it. The washing machine has feet 5 on which it can be placed. The tab has a fabric into which at least one light guide 23 is woven, braided, and/or injected. One end of the at least one light guide 23 is routed into the hinge region 22 of the flap 2 and is arranged and configured in such a way that it can be supplied with electricity from a power supply 24 arranged inside the washing machine and/or dryer FIG. 3 is a side view of the washing machine shown in FIG. 1. The tab 3 is arranged in a protruding manner relative to the housing 1 and the flap 2. The housing 1 also has a rear wall 14 opposite the front wall 11 and a bottom wall 15. The feet 5 are arranged on the bottom wall 15, on which feet the washing machine stands in the operational set-up position.

Figure 4:
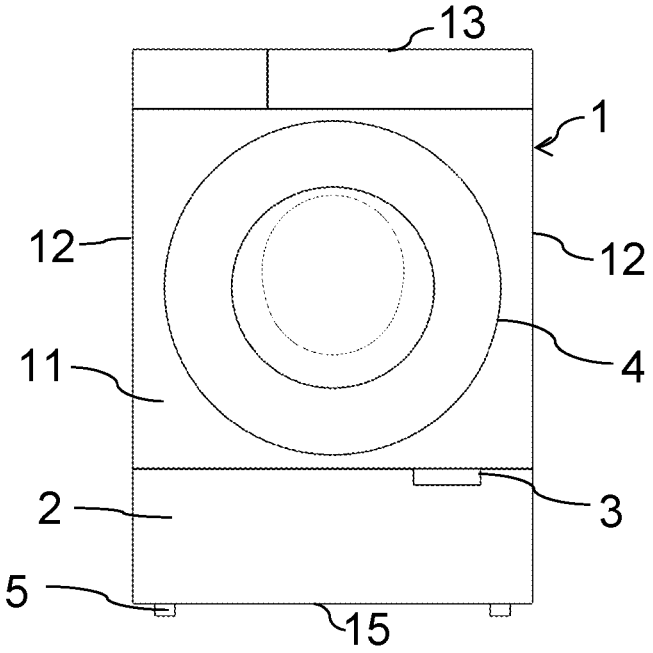
FIG. 4 is a top view of the washing machine shown in FIG. 1.

FIG. 4 is a top view of the washing machine shown in FIG. 1. When the washing machine is viewed from above, the tab 3 arranged between the front wall 11 and the flap 2 is clearly visible to the user.

LIST OF REFERENCE SIGNS

1 Housing
11 Front wall
12 Side wall
13 Top wall
14 Rear wall
15 Bottom wall
2 Flap
3 Tab
4 Door
5 Foot

The invention claimed is:

1. A washing machine and/or dryer, comprising a housing, a flap integrated into the housing, and a tab made of a soft and/or flexible material, which tab is arranged on the flap in a protruding manner relative to the housing and the flap, and is configured such that, by pulling on the tab, a folding of the flap from the housing is triggered, wherein the tab has at least one light guide and a fabric into which the at least one light guide is woven, braided, and/or injected.

2. The washing machine and/or dryer according to claim 1, wherein the tab is attached to a tab attachment region of the flap, which tab attachment region is opposite a hinge region of the flap.

3. The washing machine and/or dryer according to claim 1, wherein the tab is arranged on an upper region of the flap relative to an operational set-up position of the washing machine and/or dryer.

4. The washing machine and/or dryer according to claim 1, wherein the tab is designed in the form of a loop.

5. The washing machine and/or dryer according to claim 1, wherein the tab is screwed to the flap and/or clamped in the flap.

6. The washing machine and/or dryer according to claim 1, wherein one end of the at least one light guide is routed into a hinge region of the flap and is supplied with electricity from a power supply arranged inside the washing machine and/or dryer.

7. The washing machine and/or dryer according to claim 1, wherein the tab is made of plastic material.

* * * * *